US009441348B1

(12) United States Patent
Alig et al.

(10) Patent No.: US 9,441,348 B1
(45) **Date of Patent: *Sep. 13, 2016**

(54) HYDRAULIC SYSTEM WITH OPERATOR SKILL LEVEL COMPENSATION

(71) Applicant: Caterpillar Inc., Peoria, IL (US)

(72) Inventors: Jeffrey S. Alig, Metamora, IL (US); Conrad G. Grembowicz, Peoria, IL (US); Bradley Bomer, Pekin, IL (US); Jeffrey Fletcher, Peoria, IL (US); Karl Kirsch, Chillicothe, IL (US); Zhijun Cai, Springfield, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/675,011

(22) Filed: Mar. 31, 2015

(51) Int. Cl.

| | |
|---|---|
| ***F15B 15/14*** | (2006.01) |
| ***E02F 9/22*** | (2006.01) |
| ***E02F 3/43*** | (2006.01) |
| ***E02F 9/20*** | (2006.01) |
| ***E02F 3/42*** | (2006.01) |
| ***F15B 13/04*** | (2006.01) |

(52) U.S. Cl.
CPC ..... *E02F 9/2228* (2013.01); *E02F 3/422* (2013.01); *E02F 3/431* (2013.01); *E02F 9/2004* (2013.01); *F15B 13/0401* (2013.01); *F15B 15/14* (2013.01)

(58) Field of Classification Search
CPC ..... E02F 9/2228; E02F 3/431; E02F 9/2004; E02F 3/422; F15B 15/14; F15B 13/0401
See application file for complete search history.

(56) References Cited

U.S. PATENT DOCUMENTS

| | | | | |
|---|---|---|---|---|
| 5,101,627 | A | 4/1992 | Fujii et al. | |
| 2005/0246040 | A1 | 11/2005 | Horkavi et al. | |
| 2009/0132131 | A1* | 5/2009 | Takeda | B25D 9/145 701/50 |

FOREIGN PATENT DOCUMENTS

| | | | |
|---|---|---|---|
| JP | 1-127731 | A | 5/1989 |
| JP | 5-321296 | A | 12/1993 |
| JP | 10-212740 | A | 8/1998 |
| JP | 2986471 | B2 | 12/1999 |

* cited by examiner

*Primary Examiner* — Yuen Wong
(74) *Attorney, Agent, or Firm* — Leydig, Voit & Mayer, Ltd.

(57) ABSTRACT

A hydraulic system for a machine is provided including a first cylinder, a pump and an operator input device for entering a commanded rate of flow of hydraulic fluid to the first cylinder. A control valve operatively is connected between the pump and the first cylinder. A sensor is configured and arranged to provide signals relating to a first operating characteristic of the machine. A controller is in communication with the operator input device, the control valve and the sensor. The controller is configured to determine a skill level of an operator of the machine based on a comparison of the first operating characteristic of the machine and a first threshold and to direct the control valve to provide hydraulic fluid to the first cylinder at an adjusted hydraulic fluid flow rate if the skill level of the operator is below a predetermined level.

15 Claims, 7 Drawing Sheets

HYDRAULIC SYSTEM WITH OPERATOR SKILL LEVEL COMPENSATION

TECHNICAL FIELD

This disclosure relates generally to a hydraulic system and, more particularly, to a hydraulic system that compensates for the operator's skill level.

BACKGROUND

Machines such as, for example, wheel loaders, track-type tractors, motor graders, dozers, and other mobile machines may be used to perform a variety of operations associated with an industry such as mining, farming, construction, transportation, or any other industry. Operators of such machines may have a variety of skill levels. It may take a significant amount of training on a machine before an operator may be characterized as an expert or even an intermediate operator.

Machine operators are often trained in computer-based simulators and perform on-machine training exercises prior to performing actual work-related operations. While these methods may provide a basic level of operational exposure, they may not provide an environment that completely prepares the operator for actual "real-world" work experiences associated with a job site. Thus, many inexperienced machine operators may require additional on-the-job training in machine operation.

JPH01127731A discloses a method in which a controller for an operating valve of an earth-moving machine compensates input signals from an operating lever of the machine based on whether a mode switch is activated. The mode switch can be activated for inexperienced machine operators in order to provide compensation of the input signals from the operating lever. With more experienced machine operators, the mode switch is deactivated and no compensation is applied to the input signals from the operator. While this method can help inexperienced operators operate a machine more effectively, it is dependent upon the operator selecting the proper mode for his skill level.

SUMMARY

In one aspect, the disclosure describes a hydraulic system for a machine including a first cylinder movable between extended and retracted positions in response to flow of hydraulic fluid into and out of the cylinder; a pump configured to supply pressurized hydraulic fluid to the first cylinder; and an operator input device for entering a commanded rate of flow of hydraulic fluid to the first cylinder. A control valve is operatively connected between the pump and the first cylinder. The control valve is configured to selectively place the pump in fluid communication with the first cylinder and control the flow of hydraulic fluid into and out of the first cylinder. A sensor is configured and arranged to provide signals relating to a first operating characteristic of the machine. A controller is in communication with the operator input device, the control valve and the sensor. The controller is configured to determine the operating characteristic of the machine; store a first threshold for the first operating characteristic of the machine; and determine a skill level of an operator of the machine based on a comparison of the first operating characteristic of the machine and the first threshold. The controller determines an adjusted hydraulic fluid flow rate based on the operator skill level and the commanded rate of flow that is below the commanded rate of flow if the skill level of the operator is below a predetermined skill level. The controller directs the control valve to provide hydraulic fluid to the first cylinder at the adjusted hydraulic fluid flow rate.

In another aspect, the disclosure describes a method of controlling hydraulic fluid flow relative to a cylinder of a machine. The method includes the steps of receiving a commanded rate of flow of hydraulic fluid to the cylinder from an operator through an operator input device; determining a first operating characteristic of the machine; and determining a skill level of the operator of the machine based on a comparison of the first operating characteristic to a first threshold for the operating characteristic. An adjusted hydraulic fluid flow rate is determined based on the operator skill level and the commanded rate of flow that is below the commanded rate of flow if the skill level of the operator is below a predetermined skill level. Hydraulic fluid is directed to the cylinder at the adjusted hydraulic fluid flow rate.

In yet another aspect, the disclosure describes a machine including a prime mover and a cylinder movable between extended and retracted positions in response to flow of hydraulic fluid into and out of the cylinder. An implement is operatively connected to the cylinder. A pump is operatively connected to the prime mover and configured to supply pressurized hydraulic fluid to the cylinder. An operator input device is used for entering a commanded rate of flow of hydraulic fluid to the cylinder. A control valve is operatively connected between the pump and the cylinder. The control valve is configured to selectively place the pump in fluid communication with the cylinder and control the flow of hydraulic fluid into and out of the cylinder. A sensor is configured and arranged to provide signals relating to a first operating characteristic of the machine. A controller is in communication with the operator input device, the control valve and the sensor. The controller is configured to determine the operating characteristic of the machine; store a first threshold for the first operating characteristic of the machine; and determine a skill level of an operator of the machine based on a comparison of the first operating characteristic of the machine and the first threshold. The controller determines an adjusted hydraulic fluid flow rate based on the operator skill level and the commanded rate of flow that is below the commanded rate of flow if the skill level of the operator is below a predetermined skill level. The controller directs the control valve to provide hydraulic fluid to the cylinder at the adjusted hydraulic fluid flow rate.

DETAILED DESCRIPTION

Figure 1:
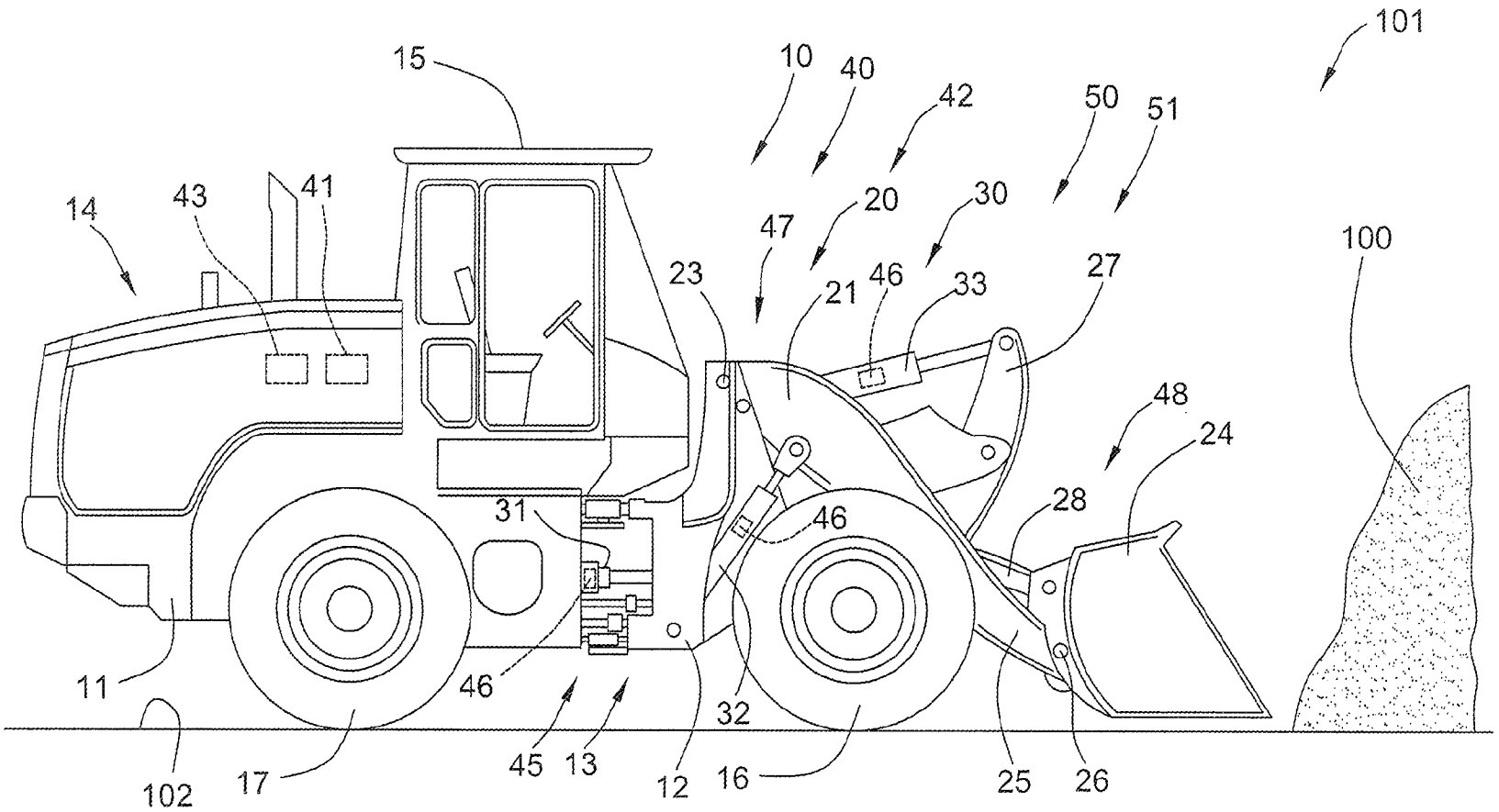
FIG. 1 is a schematic side view of an exemplary machine with which the present disclosure may be implemented.

This disclosure generally relates to a system and method for adjusting operation of a hydraulic system based on the operator's skill level. Referring to FIG. 1, a machine 10 is shown that may operate to move material 100 about a work site 101. While the machine 10 is depicted as a wheel loader, it is to be understood that the teachings of this disclosure are applicable to many other types of machines. The machine 10 may include a body having a base portion 11 and an implement support portion 12 pivotally mounted on the base portion by an articulating joint 13. The base portion 11 houses a prime mover 14 such as an engine and an operator station or cab 15 in which an operator may be positioned. The prime mover 14 is operatively connected to and drives a ground engaging drive mechanism such as front wheels 16 and rear wheels 17 to operate as a propulsion system. The base portion 11 includes the rear wheels 17 while the implement support portion 12 includes the front wheels 16. The articulating joint 13 permits the implement support portion 12 to pivot or move relative to the base portion 11 for purposes of steering the machine 10.

The implement support portion 12 includes a linkage 20 having one or more lift arms 21 pivotally connected to the implement support portion 12 at first pivot joint 23. A work implement such as bucket 24 may be pivotally mounted at a distal end 25 of the lift arms 21 at a second pivot joint 26. A curl lever 27 may be pivotally mounted on curl lever support member 22 of implement support portion 12 with a first end (not shown) connected to a curl link member 28 that is pivotally connected to bucket 24. With this configuration, rotation of the curl lever 27 results in curling or tilting of the bucket 24 about the second pivot joint 26.

The machine 10 may include a system such as a hydraulic system generally indicated at 30 for operating various systems and components of the machine. A pair of steering cylinders 31 (only one being visible in FIG. 1) extends between the base portion 11 and the implement support portion 12 and operate to control the movement of the implement support portion relative to the base portion about the articulating joint 13 to control the steering of the machine 10. A pair of lift cylinders 32 (only one being visible in FIG. 1) may operatively extend between the implement support portion 12 to the lift arms 21 to facilitate raising and lowering of the lift arms about first pivot joint 23. A curl cylinder 33 may operatively extend between the implement support portion 12 and the curl lever 27 to facilitate rotation or tilting of the bucket 24 about second pivot joint 26. The steering cylinders 31, the lift cylinders 32, and the curl cylinder 33 may be electro-hydraulic cylinders or any other type of desired cylinders.

Figure 2:
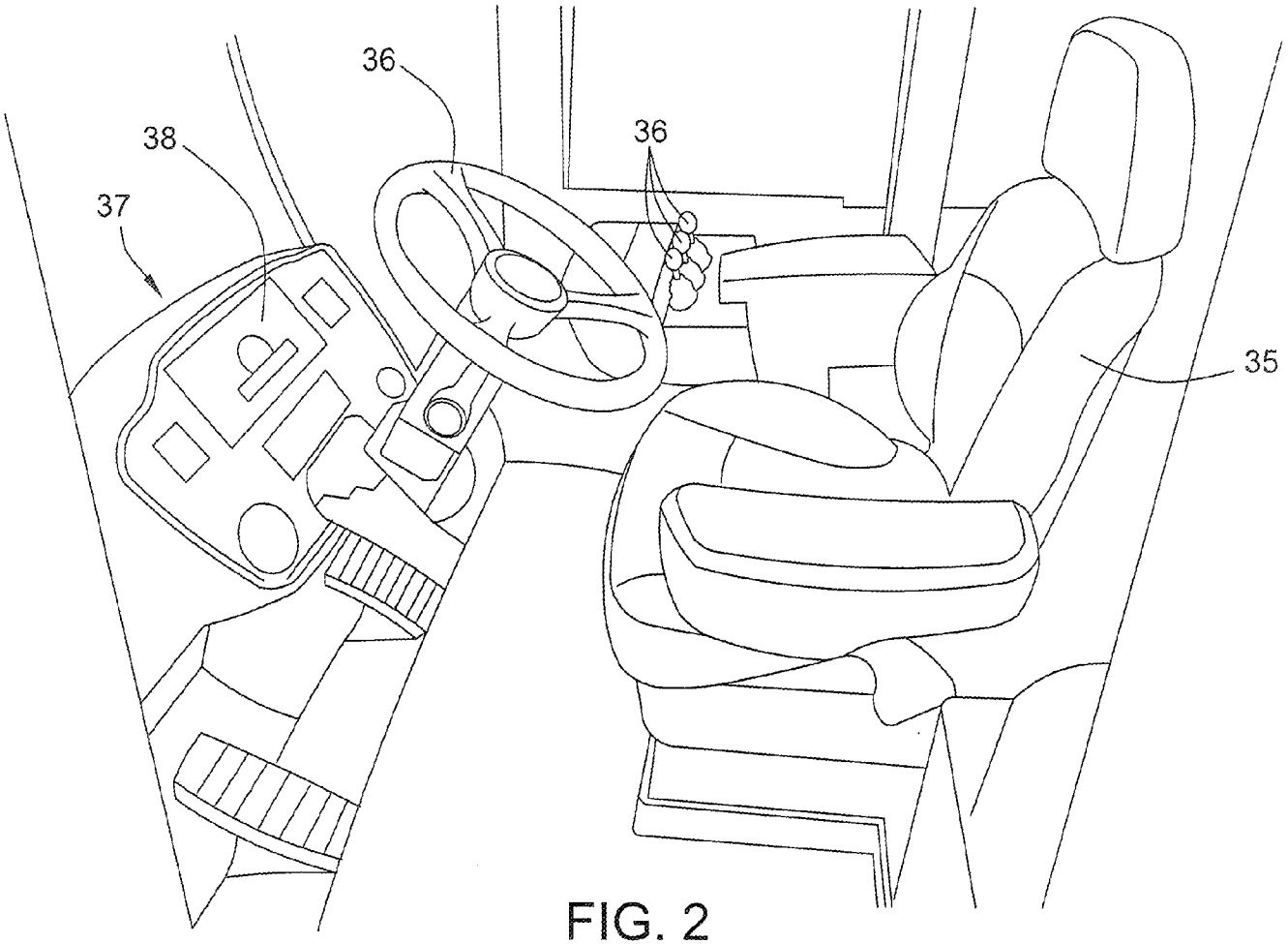
FIG. 2 is a perspective view of a cab of the machine of FIG. 1.

Referring to FIG. 2, the cab 15 may include an operator seat 35, one or more input devices 36 such as a steering wheel, levers, knobs, buttons, joysticks, etc. through which the operator may issue commands to control the operation of the machine 10 such as the propulsion and steering as well as operate various implements associated with the machine. One or more instrument arrays 37 may be positioned within the cab 15 to provide information to the operator and may further include additional input devices such as knobs and buttons. The cab 15 may further include a visual image display device such as a display screen 38.

The machine 10 may include a control system 40, as shown generally by an arrow in FIG. 1 indicating association with the machine. The control system 40 may utilize one or more sensors to provide data and input signals representative of various operating parameters of the machine 10 and/or the environment of the work site 101 at which the machine is operating. The control system 40 may include an electronic control module or controller 41 and a plurality of sensors associated with the machine 10.

The controller 41 may be an electronic controller that operates in a logical fashion to perform operations, execute control algorithms, store and retrieve data and other desired operations. The controller 41 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 41 such as power supply circuitry, signal conditioning circuitry, driver circuitry, and other types of circuitry.

The controller 41 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine. The functionality of the controller 41 may be implemented in hardware and/or software without regard to the functionality. The controller 41 may rely on one or more data maps relating to the operating conditions and the operating environment of the machine 10 and the work site 101 that may be stored in the memory of controller. Each of these data maps may include a collection of data in the form of tables, graphs, and/or equations.

The control system 40 and the controller 41 may be located on the machine 10 or may be distributed with components also located remotely from the machine such as at a command center (not shown). The functionality of control system 40 may be distributed so that certain functions are performed at machine 10 and other functions are performed remotely. In such case, the control system 40 may include a communications system such as wireless network system (not shown) for transmitting signals between the machine 10 and a system located remote from the machine such as at the command center.

The machine 10 may be equipped with a plurality of machine sensors that provide data indicative (directly or indirectly) of various operating parameters of the machine and/or the operating environment in which the machine is operating. The term "sensor" is meant to be used in its broadest sense to include one or more sensors and related components that may be associated with the machine 10 and that may cooperate to sense various functions, operations, and operating characteristics of the machine and/or aspects of the environment in which the machine is operating.

A position sensing system 42, as shown generally by an arrow in FIG. 1 indicating association with the machine 10, may include a position sensor 43, also shown generally by an arrow in FIG. 1 to indicate association with the machine, that is operative to sense the position of the machine relative to the work site 101. The position sensor 43 may include a plurality of individual sensors that cooperate to generate and provide position signals to the controller 41 indicative of the position of the machine 10. In one example, the position sensor 43 may include one or more sensors that interact with a positioning system such as a global navigation satellite system or a global positioning system to operate as a position sensor. The controller 41 may use position signals from the position sensor 43 to determine the position of the machine 10 within work site 101. In other examples, the position sensor 43 may include an odometer or another wheel rotation sensing sensor, a perception based system, or may use other systems such as lasers, sonar, or radar to determine all or some aspects of the position of machine 10.

An articulating joint position sensor 45, as shown generally by an arrow in FIG. 1, may be provided and is operative to sense the angular position of the implement support portion 12 relative to the base portion 11 as it rotates about the articulating joint 13. In one embodiment, the articulating joint position sensor 45 may be configured as displacement sensors 46 associated with each of the steering cylinders 31. The displacement sensors 46 may generate and provide displacement signals to controller 41 indicative of the displacement of each of the steering cylinders 31. The controller 41 may analyze the displacement signals from each steering cylinder 31 to determine the displacement of each steering cylinder and then determine the angular orientation of the implement support portion 12 relative to the base portion 11 based upon the relative positions of the steering cylinders.

A lift position sensor 47, as shown generally by an arrow in FIG. 1, may be provided and operate to sense the angular position of the lift arms 21 relative to the implement support portion 12 as the lift arms rotate about the first pivot joint 23. In one embodiment, the lift position sensor 47 may be configured as a displacement sensor 46 associated with one or more of the lift cylinders 32. The displacement sensors 46 may generate and provide displacement signals to the controller 41 indicative of the displacement of the lift cylinders 32. The controller 41 may analyze the displacement signals from the displacement sensors 46 to determine the position of the lift arms 21 based upon the position of the lift cylinders and the dimensions of the lift arms and lift cylinders 32. In other words, based upon the extent to which the lift cylinders 32 are extended, the controller 41 may determine the angle of the lift arms 21 relative to the implement support portion 12.

A curl position sensor 48, as shown generally by an arrow in FIG. 1, may be provided and be operative to sense the angular position of the bucket 24 relative to the lift arms 21 as the bucket rotates about the second pivot joint 26. In one embodiment, the curl position sensor 48 may be configured as a displacement sensor 46 associated with the curl cylinder 33. The displacement sensor 46 may generate and provide displacement signals to controller 41 indicative of the displacement of the curl cylinder 33. The controller 41 may analyze the displacement signals from the displacement sensor 46 to determine the position of the bucket 24 based upon the position of the curl cylinder 33 and the dimensions of the curl lever support member 22, curl lever 27, curl link member 28, and curl cylinder 33. Based upon the extent to which the curl cylinder 33 is extended, the controller 41 may determine the angle of the bucket 24 relative to the lift arms 21.

Other types of sensors such as, for example, rotary potentiometers may be used rather than cylinder displacement sensors to determine the relative angles between the pivotable components (i.e., implement support portion 12 relative to base portion 11, lift arms 21 relative to implement support portion 12, and bucket 24 relative to lift arms 21). Additional sensors may be provided, if desired, to generate signals indicative of the relative angular velocity and angular acceleration between the pivotable components as they rotate about their pivot joints. In an alternate embodiment, the controller 41 may be configured to determine the relative angular velocity and angular acceleration based upon the signals from the different position sensors. For example, the controller 41 may monitor or determine the rate of change of the relative positions of the components to determine the angular velocity.

Figure 3:
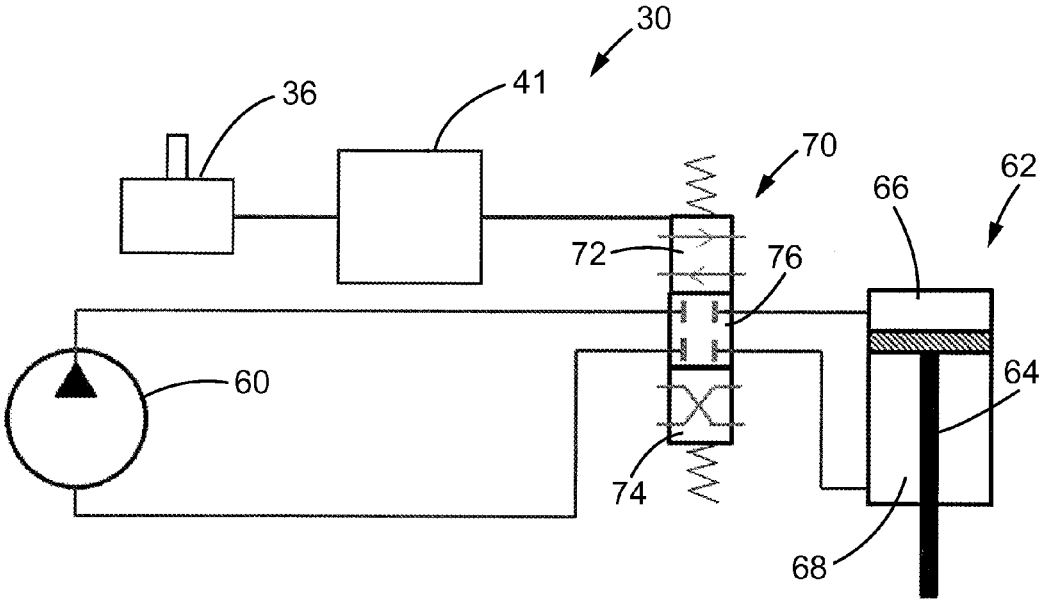
FIG. 3 is a schematic illustration of an exemplary hydraulic system according to the present disclosure.

A simplified schematic of the hydraulic system 30 that may be used to direct movement of the work implement of the machine 10, in the case the bucket 24, is provided as FIG. 3. In FIG. 3, the electro-hydraulic system includes a hydraulic pump 60 which supplies pressurized hydraulic fluid to a hydraulic device, which is a cylinder 62 in the illustrated embodiment. The pump 60 may be driven by the prime mover 14 of the machine 10. The hydraulic pump 60 may, in turn, be coupled to a hydraulic fluid source. While the hydraulic fluid source is not illustrated in FIG. 3, those of skill in the art will understand the inclusion of the same, as well as hydraulic lines coupling the various components of the hydraulic system 30. Although a single pump 60 is illustrated, multiple pumps may be utilized including different pumps devoted to specific operations of the machine 10. Additionally, while a fixed displacement pump 60 is shown in FIG. 3, one or more variable displacement pumps may also be used.

The cylinder 62 of FIG. 3 is generic and may represent with respect to the embodiment of FIG. 1 one or more of the steering cylinders 31, lift cylinders 32 and/or curl cylinder 33. The cylinder 62 may be configured to move between extended and retracted positions in response to flow of hydraulic fluid into and out of the cylinder. The cylinder 62 may be a double acting hydraulic cylinder with a piston 64 that is slidably received in a housing. The piston 64 may divide the internal chamber of the cylinder housing into a head end chamber 66 and a rod end chamber 68. Pressurized hydraulic fluid may flow into and out of the head and rod end chambers 66, 68 to create a pressure differential between them that can cause movement of the piston 64 and thereby extend and retract the cylinder 62.

In the embodiment shown in FIG. 3, the pump 60 is hydraulically coupled to a control valve 70 such that the pump 60 supplies pressurized fluid to the control valve 70, which, in turn, controls fluid flow to and from the head and rod end chambers 66, 68 of the cylinder 62. The control valve 70 may be operatively connected between the pump 60 and the cylinder 62 and be configured to selectively place the pump 60 in fluid communication with the cylinder 62 and control the flow of hydraulic fluid into and out of the cylinder 62. In this case, the control valve 70 is a three position valve with a first extend position 72 in which the control valve 70 directs pressurized hydraulic fluid from the pump 60 into the head end chamber 66 of the cylinder 62 and draws hydraulic fluid from the rod end chamber 68 to thereby extend the cylinder. The control valve 70 may also have a second retract position 74 in which the control valve 70 directs pressurized hydraulic fluid from the pump 60 into the rod end chamber 68 and draws hydraulic fluid out of the head end chamber 66 to thereby retract the cylinder 62. Additionally, the control valve 70 may have a third neutral or hold position 74 in which the control valve 70 blocks hydraulic fluid flow into and out of both the head and rod end chambers 66, 68. While a single control valve 70 is shown in FIG. 3, it will be appreciated that the multiple control valves may be provided. Operation of the control valve 70, and thereby extension and retraction of the cylinder 62 may be directed by one more of the input devices 36 associated with the machine 10. As noted above, the input device 36 associated with the cylinder 62 may embody a joystick, pedal(s), lever(s), switch(es), button(s), wheel(s) or other control device(s) known in the art. The input device 36 may communicate with the control valve 70 via the controller 41 as discussed in greater detail below.

The controller 41 of the machine 10 may be configured to adjust the flow of hydraulic fluid to one or more of the cylinders controlling movement of the work implement based on a determination of the skill level of the operator. In particular, with reference to the embodiment of FIG. 3, the controller 41 may be configured so as to command the control valve 70 to direct relatively less hydraulic fluid to the cylinder 62 for a given command (e.g., a given joystick displacement) entered by an operator with a relatively lower skill level through the input device 36 as compared to the amount of hydraulic fluid directed to the cylinder 62 through the control valve 70 when the same command (e.g., the same joystick displacement) is entered by an operator with a relatively higher skill level. Limiting the flow of hydraulic fluid to the cylinder 62 will allow operators having a relatively lower skill level more control over extension and retraction of the cylinder 62 and thereby movement of the implement (e.g., the bucket 24) by limiting the movement and rate of movement of the cylinder 62 for a given movement of the input device 36 by the operator. According to one embodiment, limiting of the hydraulic flow for less skilled operators may be accomplished in an electro-hydraulic system by remapping the gains of the input device 36 in the controller 41 in order to limit the current that the controller directs to the control valve 70 and thereby, again with reference to the embodiment of FIG. 3, limit the flow of hydraulic fluid through the control valve 70 to the cylinder 62. More specifically, for a given displacement of the input device 36 (e.g., a joystick), the controller 41 may direct relatively less current to the control valve 70 for an operator with a relatively lower skill level and relatively more current for an operator with a relatively higher skill level.

The control system 40 including the controller 41 may be configured to determine the skill level of the operator automatically without any manual input by the operator or other personnel associated with work site. For example, the controller 41 may be configured to determine the skill level of the operator based on inputs from at least one sensor that is configured and arranged to provide signals relating to at least one operating characteristic of the machine 10. The sensor may be related to the one or more input devices 36 or be one or more machine sensor (for example, engine speed sensors, hydraulic pressure sensors and/or machine ground speed sensors), and/or implement position sensors (for example, the articulating joint sensor 45, displacement sensors 46, the lift position sensor 47 and curl position sensor 48). The controller 41 may further be configured to use these inputs with an algorithm that would be used to evaluate and log performance of the operator so as to determine the operators skill level. The controller 41 may also use other historical operating characteristic data in determining the skill level of the operator including historical data on operating characteristics associated with one or more components and/or subsystems of machine 10 such as, for example, machine location (via the position sensing system 42); fluid pressure, flow rate, temperature, contamination level, and or viscosity of a fluid; electric current and/or voltage levels; fluid (i.e., fuel, oil, etc.) consumption rates; loading productivity/efficiency (i.e., payload value, percent of maximum payload limit, payload history, payload distribution, etc.); transmission output ratio, slip, etc.; grade; traction data; scheduled or performed maintenance and/or repair operations; and any other suitable operation data. The controller 41 may use the data from these various sources in a comparison against predetermined thresholds that differentiate the various operator skill levels. For example, the thresholds may differentiate between expert and novice skill levels or expert, intermediate and novice skill levels. Additional delineations of skill level may also be provided. For each skill level, the controller 41 may provide a different adjustment to the hydraulic fluid flow commanded by the operator through the input device 36. For example, the controller 41 may make no adjustment to the commands issued by an expert operator, a first adjustment to commands issued by an intermediate operator and a relatively larger second adjustment to commands issued by a novice operator. The determination as to the skill level of the operator may be transmitted by the controller 41 to a remote location such as a command center.

One example of data that may be used by the controller 41 in determining the operator skill level may be data generated by the machine sensors relating to whether the operator is operating multiple cylinders simultaneously. For example, with respect to the illustrated embodiment, the controller 41 may use data from the curl position sensor 48 and the lift position sensor 47 to determine whether the lift cylinders 32 and the curl cylinder 33 are being moved simultaneously. Alternatively, the controller 41 could use signals from the respective input devices 36 associated with the lift cylinders 32 and the curl cylinder 33 to determine whether the operator is directing movement of both cylinders at the same time. In general, operators with a relatively higher skill level are able to operate two or more cylinders of the machine 10 simultaneously while operators with a relatively lower skill level tend to use the different cylinders one at a time. Accordingly, if the controller 41 determines that multiple cylinders are being used simultaneously by the operator, the controller 41 may determine that there is no need to limit or adjust the flow of hydraulic fluid to the cylinders that is commanded by the operator through the operator input device 36. Conversely, if the controller 41 determines that the cylinders are being used one at a time, the controller 41 may limit or adjust downward the flow of hydraulic fluid to the cylinders through the control valve 70 that is commanded by the operator through the operator input device 36. The controller 41 may be configured with thresholds that would allow the controller 41 to determine the extent to which operation of the cylinders one at a time in an operation would indicate that the operator has a relatively lower skill level.

Another example of data that may be used by the controller 41 in determining the skill level of the operator of the machine 10 is data reflecting how smoothly one or more cylinders of the machine are being operated. In general, if the cylinder 62 (e.g., the lift cylinders 32 and/or curl cylinders 33) is being operated in a stop-and-start manner resulting in jerky movements of the cylinder and the associated implement (e.g., the bucket 24), the controller 41 may determine that the operator has a relatively low skill level and apply an adjustment to the flow of hydraulic fluid to the cylinder 62 that is requested by the operator via manipulation of the control valve 70. On the other hand, if the cylinder 62 is consistently moved smoothly by the operator, the controller 41 may determine that the operator has a relatively higher skill level and adjustments to the flow of hydraulic fluid flow commanded by the operator are unnecessary. The data regarding the smoothness of the movement of the cylinder 62 may be generated using signals from the displacement sensor associated with the corresponding cylinder (e.g., the lift position sensor 47 and/or the curl position sensor 48). Alternatively or additionally, the data regarding smoothness of the movement of the cylinder 62 may be generated using signals from other sensors such as one or more accelerometers associated with the cylinder or the implement and/or sensors from which the velocity of the cylinder or the implement may be determined. The data regarding the smoothness of the movement of the cylinder 62 may also be generated based on signals from the input device 36 used by the operator. In particular, the controller 41 may determine that an operator has a relatively low skill level based on signals indicating quick stop-and-start movements of the input device 36. The controller 41 may be configured with thresholds that could be used by the controller to determine whether the cylinder 62 is being moved smoothly or in a stop-start fashion by the operator.

Another way in which to determine an operator's skill level is to break or segment a particular operation into a plurality of quantitatively measurable tasks with each of the tasks being measured against a desired threshold. In other words, an operation may be divided into a plurality of tasks that may be evaluated based upon desired positions and speeds of the machine 10 and its various components. The operator's performance for each task as well as the overall operation may be measured and used to determine the operator's skill level.

As an example, the machine 10, configured as a wheel loader, may be used to repeatedly dig into a pile of loose material 100 such as gravel or dirt with bucket 24, lift a bucket load of material, and subsequently move the bucket load of material to a desired location such as within a haul truck (not shown). The operation of digging into the pile of material and loading the bucket 24 may be segmented into a plurality of sequential tasks and the efficiency of each task may be measured based upon operating characteristics such as the relative or absolute positions and/or speeds of movement of the machine 10 and its various components (e.g., lift arms 21 and bucket 24). The operating characteristics may be compared to one or more desired thresholds to evaluate or rate the skill level of an operator for each task as well as for the entire operation.

Figure 4:
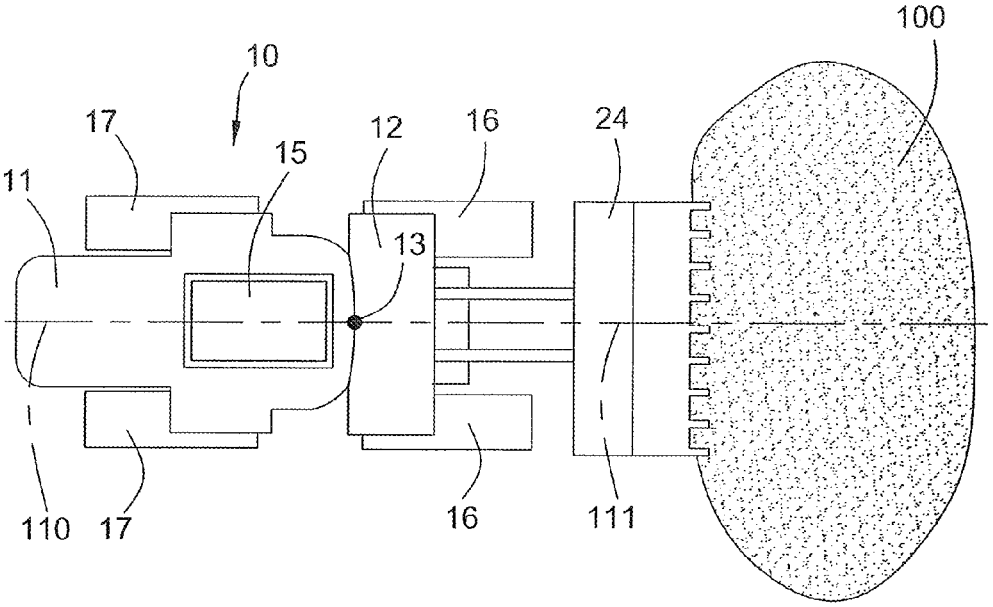
FIG. 4 is a simplified top view of the machine of FIG. 1 showing the machine being operated with a relatively higher skill level to perform a first quantitatively measurable task.
Figure 5:
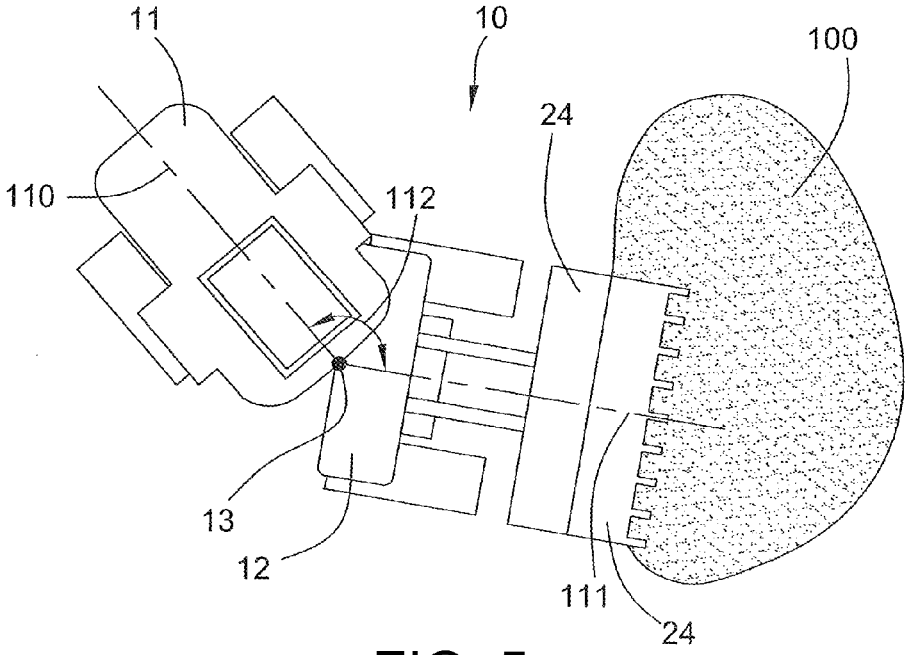
FIG. 5 is a simplified top view of the machine of FIG. 1 showing the machine being operated with a relatively lower skill level to perform the first quantitatively measurable task of FIG. 4.

FIGS. 4-11 depict a series of sequential tasks associated with loading material 100 into bucket 24 that may be quantitatively measured. Referring first to FIGS. 4-5, it is generally desirable for the machine 10 to enter a pile of material 100 with the base portion 11 and the implement support portion 12 aligned as depicted in FIG. 4. More specifically, the axis 110 of the base portion 11 and the axis 111 of the implement support portion 12 are co-linear and thus the articulation angle 112 is zero in FIG. 4 but substantially greater than zero in FIG. 5. If the base portion 11 is rotated relative to the implement support portion 12 as depicted in FIG. 5, the bucket 24 will not enter the pile of material 100 as effectively and the wheels are more likely to slip. In addition, the articulating joint 13 and components associated with the relative movement between the base portion 11 and the implement support portion 12 such as steering cylinders 31 may be subjected to additional wear due to the misalignment between the base portion and the implement support portion.

The controller 41 may determine the extent to which the base portion 11 and the implement support portion 12 (i.e., the articulation angle 112) are aligned based upon data from the articulating joint position sensor 45 as described above. One or more thresholds in the form of a maximum desired misalignment or articulation angle 112 may be stored within controller 41. The controller 41 may be configured to compare the actual misalignment between the base portion 11 and the implement support portion 12 (i.e., the articulation angle 112) to one of the thresholds in order to evaluate or measure an operator's skill level.

The controller 41 may be configured to evaluate or monitor the articulation angle 112 when the bucket 24 engages the pile of material 100. To determine when the bucket 24 initially engages the pile of material 100, the controller 41 may utilize an implement load sensor system 51 indicated generally in FIG. 1. In one embodiment, the implement load sensor system 51 may embody sensors for measuring changes in the powertrain system such as a change in the difference between output from the prime mover 14 and output from a torque converter (not shown). While approaching the pile of material 100, the engine output speed and the torque converter output speed may be relatively constant. However, upon engaging the pile of material 100, the load on the bucket 24 will be increased thus slowing the machine 10 and causing a change in the relative speeds between the prime mover 14 and the torque converter. Accordingly, by monitoring the difference between the prime mover speed and the torque converter speed, an increase in load on the bucket 24 may be determined that is indicative of engagement of the bucket with the pile of material 100.

Other manners of determining when the bucket 24 is initially engaging the pile of material 100 are contemplated. For example, in alternate embodiments in which the machine propulsion and drivetrain mechanisms are hydrostatic or electric, implement load sensor system 51 may embody other sensors that detect a difference between output from the prime mover and other aspects of the propulsion and drivetrain mechanisms. In another alternate embodiment, the implement load sensor system 51 may utilize one or more pressure sensors (not shown) associated with one or more of the hydraulic cylinders to determine when the load on the bucket 24 initially increases relatively quickly indicating the initial engagement between the bucket and the pile of material 100.

Figure 6:
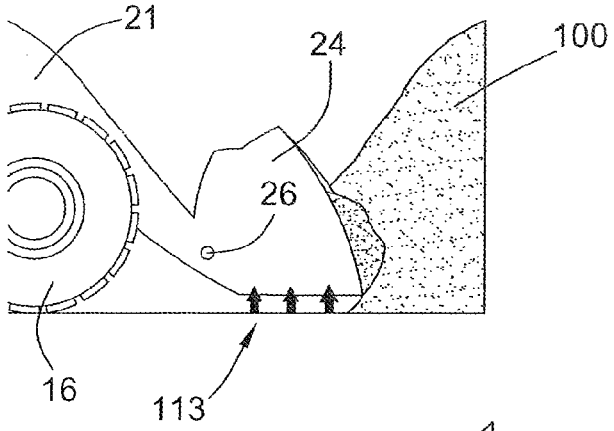
FIG. 6 is a simplified partial side view of the machine of FIG. 1 showing the machine being operated with a relatively higher skill level to perform a second quantitatively measurable task.

Referring to FIG. 6, another quantitatively measurable task associated with loading bucket 24 is depicted. As the bucket 24 engages the pile of material 100, the load on the bucket will increase substantially causing the machine 10 to slow down rapidly which may cause the front wheels 16 to slip and reduce the machine's ability to propel the bucket 24 into the pile of material. Accordingly, it is typically desirable for an operator to slightly lift the lift arms 21 (and thus bucket 24 also) as the bucket enters the pile of material 100 as depicted at 113 to thus increase the load in the bucket which will increase the tractive force of the front wheels 16. The action of slightly lifting the lift arms 21 is sometimes referred to as "setting the tires" and is desirable as it reduces wheel slip which increases efficiency and reduces tire wear. The increased tractive force also permits the bucket 24 to enter farther into the pile of material 100 and thus may increase the payload that the machine 10 may be able to effectively load into the bucket.

The controller 41 may determine whether an operator has "set the tires" by monitoring the angle of the lift arms 21 relative to the implement support portion 12 as they pivot or rotate about first pivot joint 23 based upon data from the lift position sensor 47 as described above. One or more desired thresholds may be stored within controller 41. The desired thresholds may include the extent to which the lift arms should be raised (e.g., expressed as an angle about first pivot joint 23 or a distance) as well as the timing in which the operation should begin relative to engagement of the pile of material 100 by the bucket 24. The controller 41 may be configured to compare the extent of actual movement of the lift arms 21 relative to the implement support portion 12 and its timing to the desired thresholds in order to evaluate or measure an operator's skill level.

The controller 41 may begin evaluating the operator's skill level upon determining engagement of the bucket 24 with the pile of material 100 as described above.

Figure 7:
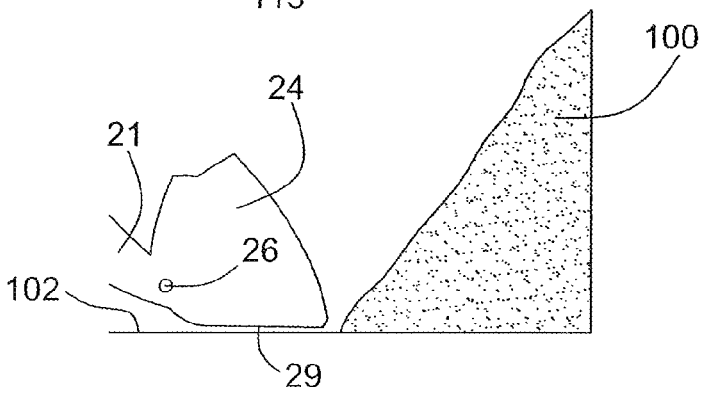
FIG. 7 is a simplified partial side view of the machine of FIG. 1 showing the machine being operated with a relatively higher skill level to perform a third quantitatively measurable task.
Figure 8:
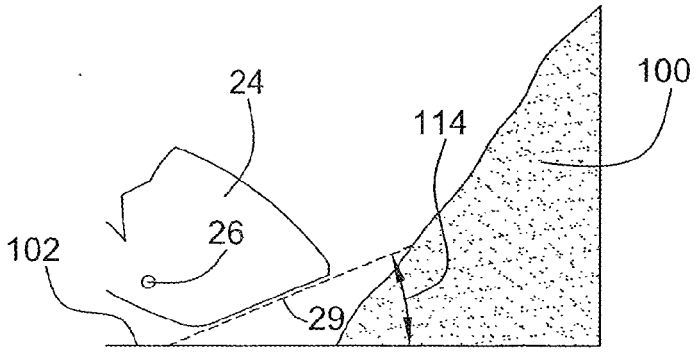
FIG. 8 is a simplified partial side view of the machine of FIG. 1 showing the machine being operated with a relatively higher skill level to perform the third quantitatively measurable task of FIG. 7.
Figure 9:
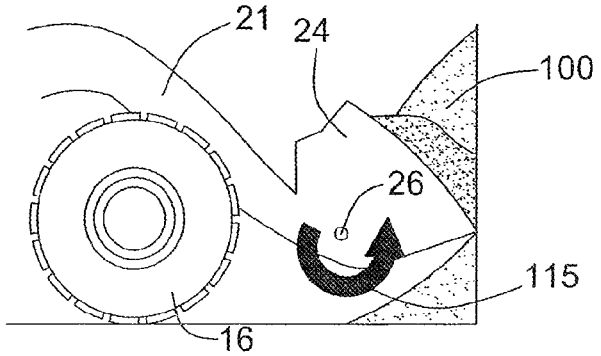
FIG. 9 is a simplified partial side view of the machine of FIG. 1 showing the machine being operated with a relatively higher skill level to perform a fourth quantitatively measurable task.

Additional quantitatively measurable tasks may be associated with the physical loading of the bucket 24 as it enters the pile of material 100. For example, it is generally desirable for the bucket 24 to enter the pile of material 100 at a desired angle relative to the ground or the pile of material, and it is generally desirable for the bucket to be curled and the lift arms 21 to be raised in a desired manner to maximize the efficiency of the bucket loading process. More specifically, it is generally desirable for the bucket 24 to enter the pile of material 100 with the lower surface 29 of the bucket generally parallel to the work surface 102 as depicted in FIG. 7. If the bucket 24 is curled upwards about second pivot joint 26, as depicted in a somewhat exaggerated manner in FIG. 8, the bucket will be less likely to effectively penetrate the pile of material 100 and may slide up the pile rather than dig into the pile which is likely to result in an under-filled bucket.

The controller 41 may determine the angle 114 (FIG. 8) of the bucket 24 as it enters the pile of material 100 relative to the work surface 102 based upon data from the position sensor 43 and the curl position sensor 48. The controller 41 may be configured to compare the actual angle 114 of the bucket 24 relative to the desired threshold in order to rate the skill level of the operator. While the lower surface 29 of the bucket 24 would be generally parallel to the work surface 102 as depicted in FIG. 7 in an ideal operation, the threshold may be stored as an angle greater than zero.

The controller 41 may begin evaluating the operator's skill level upon determining engagement of the bucket 24 with the pile of material 100 as described above.

Additional quantitatively measurable tasks may also be associated with the specific manner in which the bucket 24 is loaded. When loading bucket 24, it is generally desirable for the machine to move forward with the bucket beginning to penetrate the pile of material 100 and then slightly curling the bucket or rotating it upward about second pivot joint 26 as depicted by arrow 115 in FIG. 9 by actuating curl cylinder 33. The process is repeated by alternatingly moving the machine 10 slightly forward farther into the pile of material and then slightly curling the bucket an additional amount so that additional material will be gathered into the bucket. The process may be continued until the bucket is completely filled.

Figure 10:
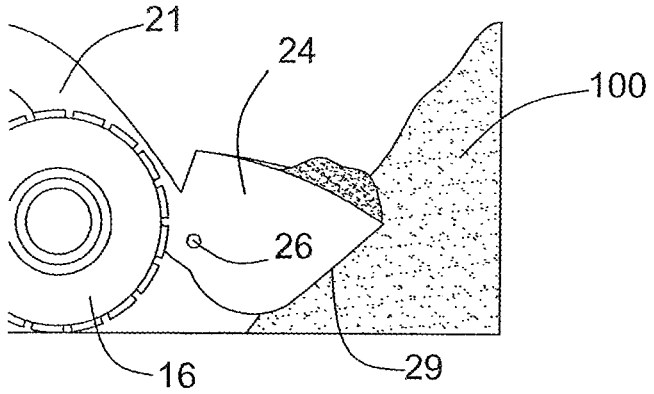
FIG. 10 is a simplified partial side view of the machine of FIG. 1 showing the machine being operated with a relatively lower skill level to perform the fourth quantitatively measurable task of FIG. 9.

In one example, poor or inefficient filling of the bucket 24 will occur if the bucket is curled too quickly about second pivot point 26 as the bucket engages the pile of material 100. When curling the bucket 24 too quickly, the angle of the bucket will be pointed somewhat upward so that the bucket does not effectively dig into the pile of material 100 as depicted in FIG. 10 as the machine 10 moves into the pile of material 100, resulting in the bucket being only partially filled.

The controller 41 may determine whether an operator has curled the bucket 24 too quickly based upon data from the curl position sensor 48, which may be used to determine the actual position of the bucket or the rate at which the bucket is rotating, as well as based upon data from the position sensor 43 as the machine 10 moves forward into the pile of material 100.

The controller 41 may begin evaluating the operator's skill level upon determining engagement of the bucket 24 with the pile of material 100 as described above. In one embodiment, the desired threshold set or stored within the controller 41 may include a desired amount of rotation of the bucket 24 based upon the distance that the machine 10 has moved once it has entered the pile of material 100. In another embodiment, the controller 41 may compare the rate at which the bucket 24 is rotating to a desired threshold.

Figure 11:
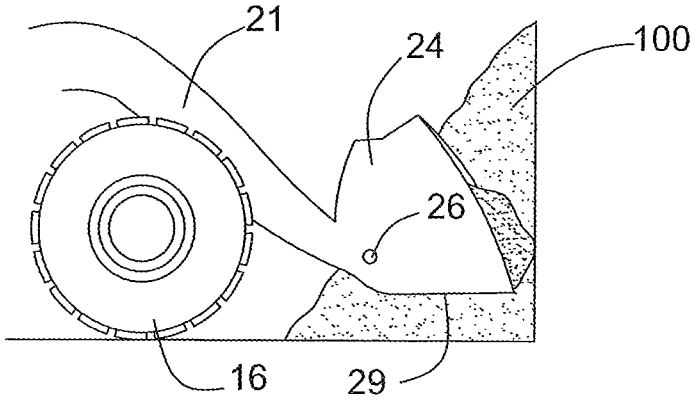
FIG. 11 is a simplified partial side view of the machine of FIG. 1 showing the machine being operated with a relatively lower skill level to perform a fifth quantitatively measurable task.
Figure 12:
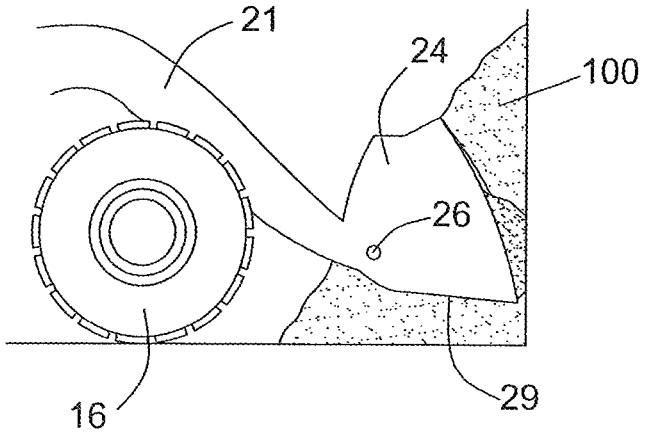
FIG. 12 is a simplified partial side view of the machine of FIG. 1 showing the machine being operated with a relatively lower skill level to perform the fifth quantitatively measurable task of FIG. 10.

In another example, poor or inefficient filling of the bucket 24 will occur if the bucket is curled and uncurled or "pumped" as the bucket is moved into the pile of material 100 as depicted in FIGS. 11-12. Pumping of the bucket 24 may occur when the operator causes the bucket to enter the pile of material 100 at a proper angle (FIG. 11), curls the bucket to partially load the bucket, and then uncurls the bucket (FIG. 12) to change the angle of the bucket so that it more easily enters the pile of material 100. By way of example, the lower surface 29 of bucket 24 is angled downward in FIG. 12. The operator may repeat this action as the machine 10 moves forward into the pile of material 100 to fully load the bucket 24. Pumping the bucket 24 is generally undesirable because it increases the time necessary to fill the bucket, it reduces loading on the front wheels 16 and therefore may cause tire slip, it increases the stress on the joints of the machine 10, and it may be harmful or hazardous to an operator.

The controller 41 may determine whether an operator is pumping the bucket 24 based upon data from the curl position sensor 48 as well as based upon data from the position sensor 43 as the machine 10 moves forward into the pile of material 100. The controller 41 may begin evaluating the operator's skill level upon engagement of the bucket 24 with the pile of material 100. The controller 41 may monitor the angle of the bucket 24 relative to the lift arms 21 and compare the amount or angle of uncurling of the bucket about second pivot joint 26, if any, to a threshold angle. In one embodiment, a single act of uncurling of the bucket 24 by more than a threshold angle may be an indication that the operator has a relatively low skill level. In another embodiment, multiple events of uncurling of the bucket 24 by more than a threshold angle as the machine 10 moves forward into the pile of material 100 may be an indication that the operator has a relatively low skill level.

In still another example, poor or inefficient filling of the bucket 24 will occur if the operator uses the lift arms 21 as a significant part of the bucket filling process rather than utilizing the curl cylinder 33 and the forward movement of the machine 10. When improperly using the lift arms 21, the operator may significantly raise the lift arms while only minimally curling the bucket 24. Excessive use of the lift arms 21 during the bucket loading process is generally undesirable as it will increase the time required to fill the bucket 24, may cause tire slip, and may cause the machine 10 to climb up the pile of material 100 which may damage the tires and put the machine in an unstable position.

The controller 41 may determine whether an operator is loading the bucket 24 using the lift arms 21 based upon data from the lift position sensor 47 as well as based upon data from the position sensor 43 as the machine 10 moves forward into the pile of material 100. The controller 41 may begin evaluating the operator's skill level upon engagement of the bucket 24 with the pile of material 100 and terminate the analysis once the machine 10 begins moving in reverse away from the pile of material. The controller 41 may monitor the angle of the lift arms 21 relative to the implement support portion 12 and compare movement of the lift arms about first pivot joint 23 to a threshold angle or amount of movement. In one embodiment, the controller 41 may be configured so that the lift arms 21 are only to be used while setting the tires as described above. In another embodiment, raising the lift arms 21 more than a threshold angle or distance may be an indication that the operator has a relatively low skill level.

In a further example, poor or inefficient filling of the bucket 24 may occur if the machine 10 is in second gear during the bucket filling process. In other words, it is generally desirable for the machine 10 to be in first gear as the bucket 24 engages the pile of material 100 and the bucket is filled. If the machine 10 is in second gear rather than first gear, the bucket 24 may be less likely to penetrate the pile of material 100 and therefore the bucket may not be filled as desired.

The controller 41 may determine whether the machine is in first gear or has been shifted into a state that will permit it to automatically shift from second gear to first gear based upon the status of an input device associated with the transmission (not shown) of the machine. In one embodiment, the controller 41 may begin evaluating the status of the transmission upon engagement of the bucket 24 with the pile of material 100. In another embodiment, it may be desirable for the operator to shift the transmission into first gear or into an auto-shift mode a predetermined time or distance before the bucket 24 engages the pile of material 100. In such case, the controller may 41 monitor the status of the transmission and compare the time of shifting to the time that the bucket 24 engages the pile of material to determine whether a shift was made within or outside the desired threshold.

As described above, a plurality of quantitatively measurable tasks may be performed as part of an operation to load a bucket 24 with material. The skill level with which the operation has been performed may be determined by evaluating whether the tasks are being performed within the desired thresholds. The controller 41 may be configured to store different thresholds for each task.

The controller 41 may analyze the quantitatively measurable tasks that make up an operation in order to rate or determine the skill level of the operator based on the quality of the entire operation.

Figure 13:
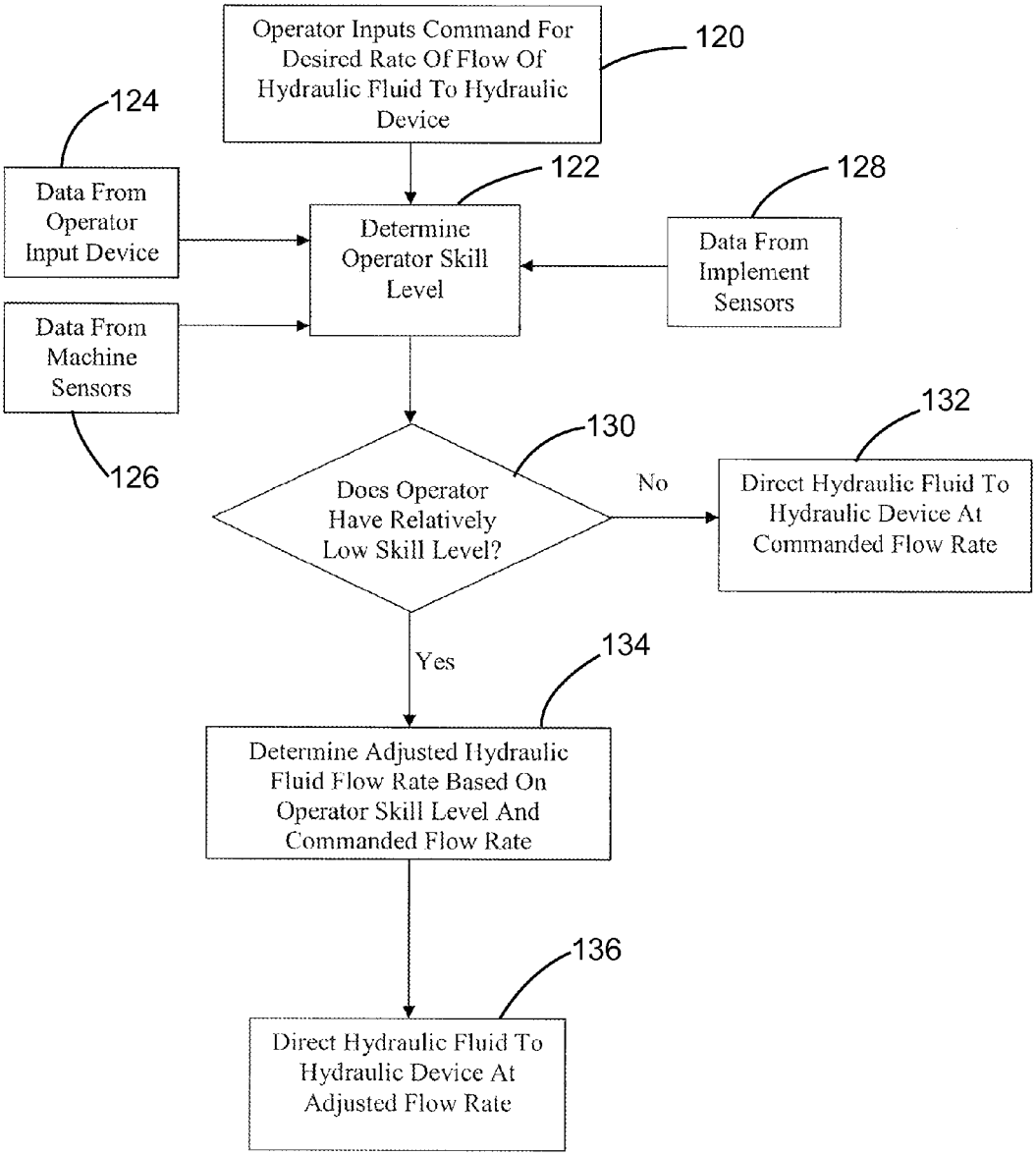
FIG. 13 is a schematic flow diagram of an exemplary method for adjusting a hydraulic system for operator skill level.

Referring to FIG. 13 of the drawings, a schematic flow diagram is provided that includes various steps that may be implemented by the controller 41 to compensate operation of the hydraulic system 30 for the skill level of the operator. In step 120, an operator may input a command for a desired rate of flow of hydraulic fluid to a hydraulic device, such as the cylinder 62 of FIG. 3. The input command may also be thought of as a desired movement of the implement of the machine 10, e.g. the bucket 24. The commanded flow rate may input by the operator through one or more operator input device 36, such as a joystick. In step 122, the controller 41 may determine the skill level of the operator. As noted above, the operator skill level may be determined automatically by the controller 41 by referencing data or signals on at least one operating characteristic of the machine provided by, for example, the operator input device (referenced as 124 in FIG. 13), machine sensors (referenced as 126) and/or implement sensors (referenced as 128) and comparing such data or signals to predetermined thresholds that distinguish the skill level of the operator. The determination of the operator skill level does not have to be performed only after the inputting of a command by the operator or after the inputting of each command. Instead, the determination of the operator skill level (step 122) can be an ongoing process in the controller 41 and/or a determination that is made based on one or more actions or commands made by the operator that is then applied to one or more subsequent commands input by the operator.

In decision step 130, the controller 41 proceeds to step 132 and directs hydraulic fluid (e.g., via the control valve 70) to the hydraulic device (e.g., the cylinder 62) at the commanded rate if it has been determined that the operator has a relatively high skill level. If the operator has a relatively low skill level, the controller proceeds from decision step 130 to step 134 and determines an adjusted hydraulic fluid flow rate based on the operator skill level and the commanded flow rate. Then in step 136 the controller directs (e.g., via the control valve 70) hydraulic fluid to the hydraulic device (e.g., the cylinder 62) at the adjusted flow rate, which typically would be less than the commanded flow rate.

INDUSTRIAL APPLICABILITY

The system and method of adjusting operation of a hydraulic system based on the operator's skill level of the present disclosure is applicable for use with any type of machine having a hydraulically operated implement and particularly those machines on which operators frequently require training. In particular, the slower hydraulic response produced with the disclosed system and method will allow a less skilled operator such as a novice operator to gain experience operating the machine using complex machine controls without causing undesired contact with other machines or obstacles or undue disturbance of the worksite. Because the system determines the skill level of the operator automatically, there is no need for the operator or other personnel at the work site to enter skill level information into the machine thereby eliminating the possibility that the operator will overrate his or her skill level with the machine.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A hydraulic system for material handling by a machine comprising:

a first cylinder movable between extended and retracted positions in response to flow of pressurized hydraulic fluid into and out of the first cylinder;

a pump configured to supply pressurized hydraulic fluid to the first cylinder;

an operator input device for entering a commanded rate of flow of pressurized hydraulic fluid to the first cylinder;

a control valve operatively connected between the pump and the first cylinder, the control valve being configured to selectively place the pump in fluid communication with the first cylinder and control the flow of pressurized hydraulic fluid into and out of the first cylinder;

a sensor configured and arranged to provide signals relating to a first operating characteristic of the machine; and a controller in communication with the operator input device, the control valve and the sensor, wherein the controller is configured to:

determine the first operating characteristic of the machine, store a first threshold for the first operating characteristic of the machine in a memory, determine a skill level of an operator of the machine based on a comparison of the first operating characteristic of the machine and the first threshold, determine an adjusted hydraulic fluid flow rate based on the skill level of the operator and the commanded rate of flow, when the skill level of the operator is below a predetermined skill level, control the control valve to provide pressurized hydraulic fluid to the first cylinder at the adjusted hydraulic fluid flow rate, wherein adjusted hydraulic fluid flow rate is below the commanded rate of flow, and when the skill level of the operator is above the predetermined skill level, control the control valve to provide pressurized hydraulic fluid to the first cylinder at the commanded rate of flow, wherein the controller is further configured to determine a plurality of segments the machine is sequentially performing with the first operating characteristic of the machine, store a respective first threshold for the first operating characteristic of the machine for each of the plurality of segments in the memory and determine the skill level of the operator based on a comparison of the first operating characteristic of the machine to the respective first threshold for each of the plurality of segments.

2. The hydraulic system of claim 1 wherein the first operating characteristic is a position of the first cylinder.

3. The hydraulic system of claim 1 further including a second cylinder and wherein the first operating characteristic is simultaneous movement of the first cylinder and the second cylinder.

4. The hydraulic system of claim 1 wherein the first operating characteristic is a smoothness of motion of the first cylinder.

5. The hydraulic system of claim 1 wherein the first operating characteristic is a smoothness of motion of the operator input device.

6. The hydraulic system of claim 1 further including a linkage member operatively connected to the first cylinder and a work implement operatively connected to the linkage member and wherein the first operating characteristic is a position on one of the linkage member and the work implement.

7. The hydraulic system of claim 6 wherein the first operating characteristic is an angular velocity of the one of the linkage member and the work implement.

8. A method of controlling pressurized hydraulic fluid flow relative to a cylinder of a machine for material handling, the method comprising:

moving the cylinder between extended and retracted positions in response to flow of pressurized hydraulic fluid into and out of the cylinder;

receiving, by a controller, a commanded rate of flow of pressurized hydraulic fluid to the cylinder from an operator through an operator input device;

connecting operatively a control valve between a pump and the cylinder, the control valve being configured to selectively place the pump in fluid communication with the cylinder and control the flow of pressurized hydraulic fluid into and out of the cylinder;

determining, by a sensor and the controller, a first operating characteristic of the machine;

determining, by the controller, a skill level of the operator of the machine based on a comparison of the first operating characteristic of the machine and a first threshold for the operating characteristic;

determining, by the controller, an adjusted hydraulic fluid flow rate based on the skill level of the operator and the commanded rate of flow;

when the skill level of the operator is below a predetermined skill level, directing, by the controller, pressurized hydraulic fluid to the cylinder at the adjusted hydraulic fluid flow rate, wherein the adjusted hydraulic fluid flow rate is below the commanded rate of flow; and when the skill level of the operator is above the predetermined skill level, directing, by the controller, pressurized hydraulic fluid to the cylinder at the commanded rate of flow;

wherein the controller is further configured to determine a plurality of segments the machine is sequentially performing with the first operating characteristic of the machine, store a respective first threshold for the first operating characteristic of the machine for each of the plurality of segments in a memory and determine the skill level of the operator based on a comparison of the first operating characteristic of the machine to the respective first threshold for each of the plurality of segments.

9. The method of claim 8 wherein the first operating characteristic is a position of the cylinder.

10. The method of claim 8 wherein the first operating characteristic is simultaneous movement of the cylinder and another cylinder.

11. The method of claim 8 wherein the first operating characteristic is a smoothness of motion of the cylinder.

12. The method of claim 8 wherein the first operating characteristic is a smoothness of motion of the operator input device.

13. A machine for handling material comprising:

a prime mover;

a first cylinder movable between extended and retracted positions in response to flow of pressurized hydraulic fluid into and out of the first cylinder;

an implement operatively connected to the first cylinder;

a pump operatively connected to the prime mover and configured to supply pressurized hydraulic fluid to the first cylinder;

an operator input device for entering a commanded rate of flow of pressurized hydraulic fluid to the first cylinder;

a control valve operatively connected between the pump and the first cylinder, the control valve being configured to selectively place the pump in fluid communication with the first cylinder and control the flow of pressurized hydraulic fluid into and out of the first cylinder;

a sensor configured and arranged to provide signals relating to a first operating characteristic of the machine; and a controller in communication with the operator input device, the control valve and the sensor, wherein the controller is configured to:

determine the first operating characteristic of the machine, store a first threshold for the first operating characteristic of the machine in a memory, determine a skill level of an operator of the machine based on a comparison of the first operating characteristic of the machine and the first threshold, determine an adjusted hydraulic fluid flow rate based on the skill level of the operator and the commanded rate of flow, when the skill level of the operator is below a predetermined skill level, control the control valve to provide pressurized hydraulic fluid to the first cylinder at the adjusted hydraulic fluid flow rate, wherein adjusted hydraulic fluid flow rate is below the commanded rate of flow, and when the skill level of the operator is above the predetermined skill level, control the control valve to provide pressurized hydraulic fluid to the first cylinder at the commanded rate of flow, wherein the controller is further configured to determine a plurality of segments the machine is sequentially performing with the first operating characteristic of the machine, store a respective first threshold for the first operating characteristic of the machine for each of the plurality of segments in the memory and determine the skill level of the operator based on a comparison of the first operating characteristic of the machine to the respective first threshold for each of the plurality of segments.

14. The machine of claim 13 wherein the first operating characteristic is a position of the first cylinder.

15. The machine of claim 13 further including a second cylinder and wherein the first operating characteristic is simultaneous movement of the first cylinder and the second cylinder.

* * * * *